US007625322B1

(12) United States Patent
Krull

(10) Patent No.: US 7,625,322 B1
(45) Date of Patent: Dec. 1, 2009

(54) EXERCISE WEIGHT ADJUSTMENT METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 30 days.

(21) Appl. No.: 11/901,784

(22) Filed: Sep. 19, 2007

(51) Int. Cl.
*A63B 21/072* (2006.01)

(52) U.S. Cl. ..... 482/107; 482/106; 482/108

(58) Field of Classification Search ..... 482/92–94, 482/98, 104–108
See application file for complete search history.

(56) References Cited

U.S. PATENT DOCUMENTS

| | | | | |
|---|---|---|---|---|
| 3,771,785 | A | 11/1973 | Speyer | 482/106 |
| 4,529,198 | A | 7/1985 | Hettick, Jr. | 482/104 |
| 4,822,034 | A | 4/1989 | Shields | 482/106 |
| 5,284,463 | A | 2/1994 | Shields | 482/107 |
| 5,637,064 | A | 6/1997 | Olson et al. | 482/108 |
| 5,769,762 | A | 6/1998 | Towley, III | 482/93 |
| 5,839,997 | A | 11/1998 | Roth | 482/107 |
| 6,033,350 | A | 3/2000 | Krull | 482/98 |
| 6,228,003 | B1 | 5/2001 | Hald et al. | 482/107 |
| 6,261,022 | B1 | 7/2001 | Dalebout | 482/107 |
| 6,322,481 | B1 | 11/2001 | Krull | 482/107 |
| 6,540,650 | B1 | 4/2003 | Krull | 482/107 |
| 6,669,606 | B2 | 12/2003 | Krull | 482/98 |
| 6,679,816 | B1 * | 1/2004 | Krull | 482/107 |
| 6,746,381 | B2 * | 6/2004 | Krull | 482/108 |
| 6,749,547 | B2 * | 6/2004 | Krull | 482/106 |
| 6,855,097 | B2 * | 2/2005 | Krull | 482/107 |
| 6,872,173 | B2 * | 3/2005 | Krull | 482/108 |
| 6,899,661 | B1 * | 5/2005 | Krull | 482/107 |
| 6,974,405 | B2 * | 12/2005 | Krull | 482/107 |
| 6,997,856 | B1 * | 2/2006 | Krull | 482/104 |
| 7,025,713 | B2 * | 4/2006 | Dalebout et al. | 482/107 |
| 7,060,011 | B1 * | 6/2006 | Krull | 482/107 |
| 7,066,867 | B2 * | 6/2006 | Krull | 482/108 |
| 7,077,790 | B1 * | 7/2006 | Krull | 482/106 |
| 7,077,791 | B2 * | 7/2006 | Krull | 482/108 |
| 7,121,988 | B2 * | 10/2006 | Walkerdine | 482/106 |
| 7,128,696 | B1 * | 10/2006 | Krull | 482/107 |
| 7,128,697 | B1 * | 10/2006 | Krull | 482/108 |
| 7,153,243 | B1 * | 12/2006 | Krull | 482/107 |
| 7,264,578 | B1 * | 9/2007 | Krull | 482/108 |
| 7,291,098 | B1 * | 11/2007 | Krull | 482/107 |
| 7,300,390 | B1 * | 11/2007 | Krull | 482/108 |
| 7,387,597 | B2 * | 6/2008 | Krull | 482/108 |

* cited by examiner

*Primary Examiner*—Lori Amerson

(57) ABSTRACT

An exercise dumbbell includes a handle member and weight plates maintained in spaced relationship at opposite ends thereof. Weight selectors are rotatable into and out of engagement with different combinations of the weight plates to secure a desired amount of mass to the handle. The weight selectors selectively underlie peripheral portions the weights to secure the weights to the handle member. Different arrangements may be used to bias the weight selectors toward desired orientations relative to the weight plates, and/or to lock the weight selectors in desired orientations relative to the weight plates.

18 Claims, 14 Drawing Sheets

Fig. 1
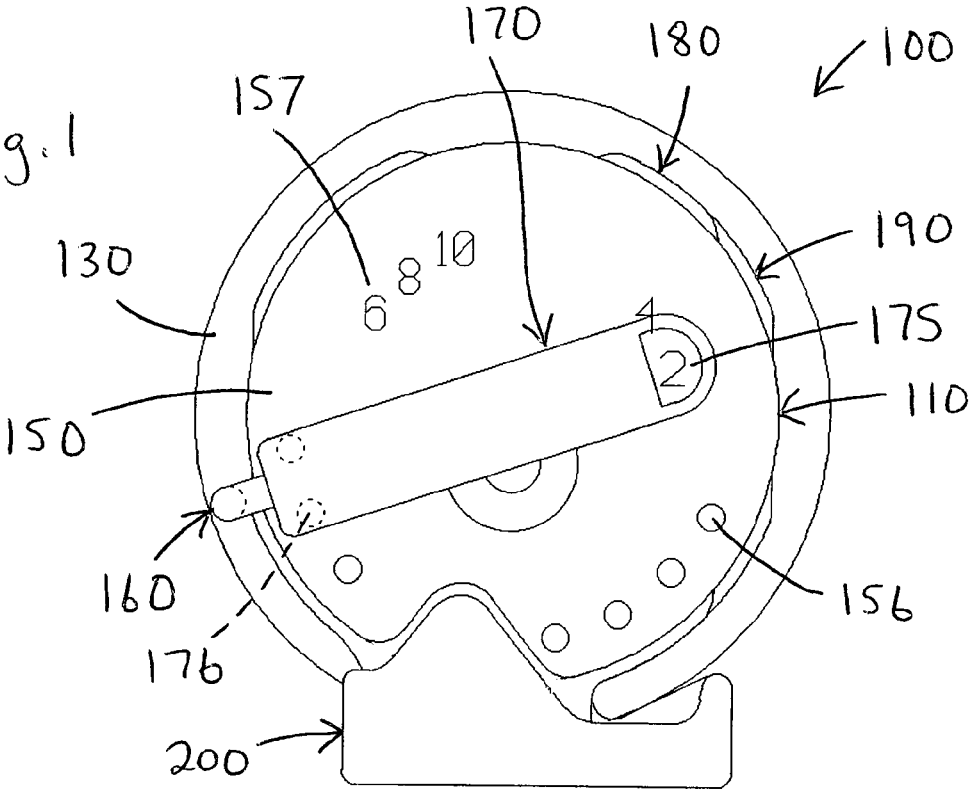
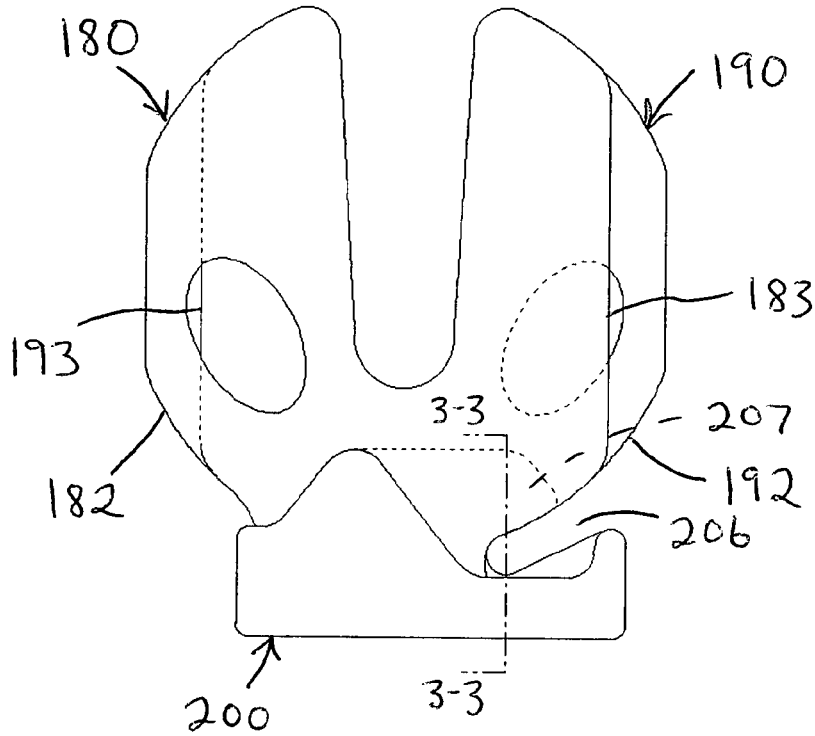
Fig. 2

Fig. 12
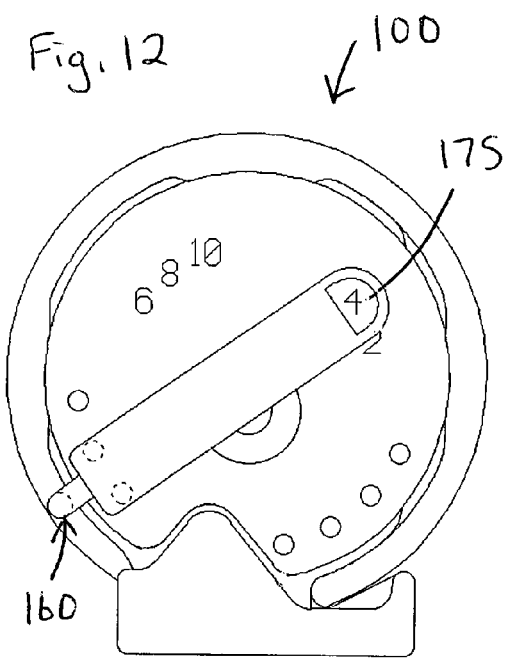
Fig. 13
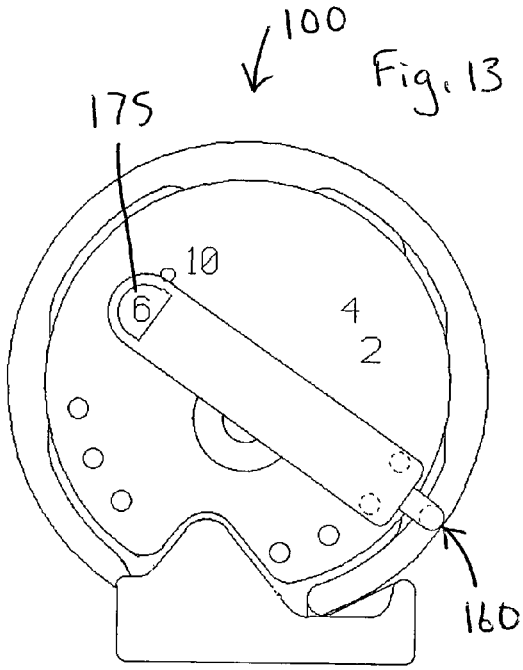
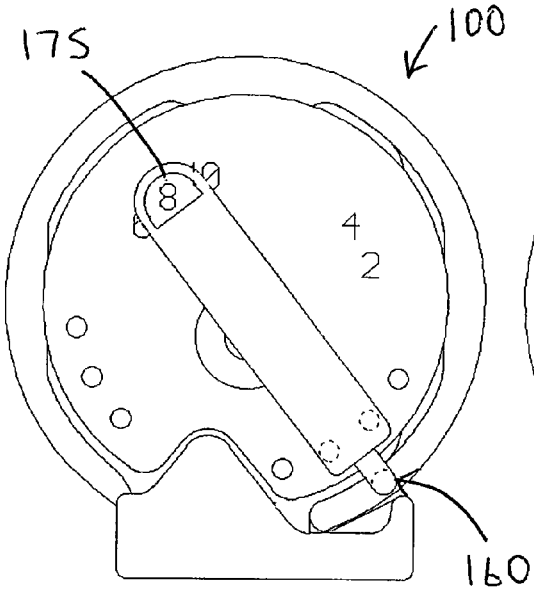
Fig. 14
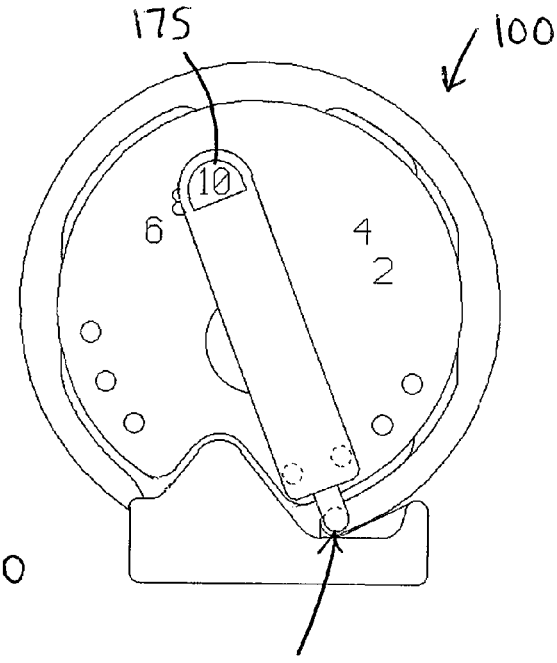
Fig. 15

Fig. 23
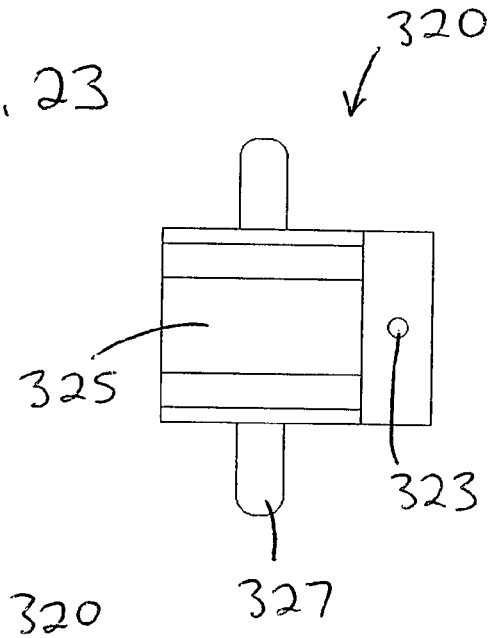
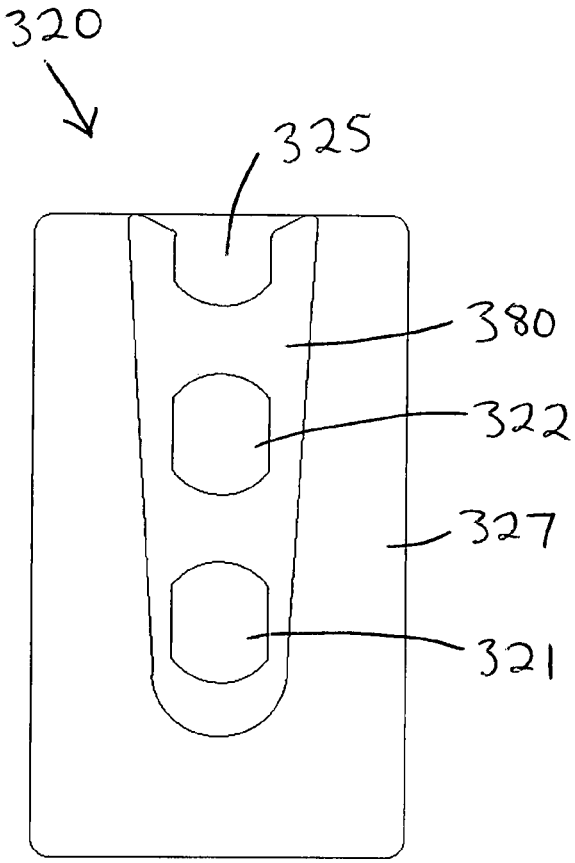
Fig. 21
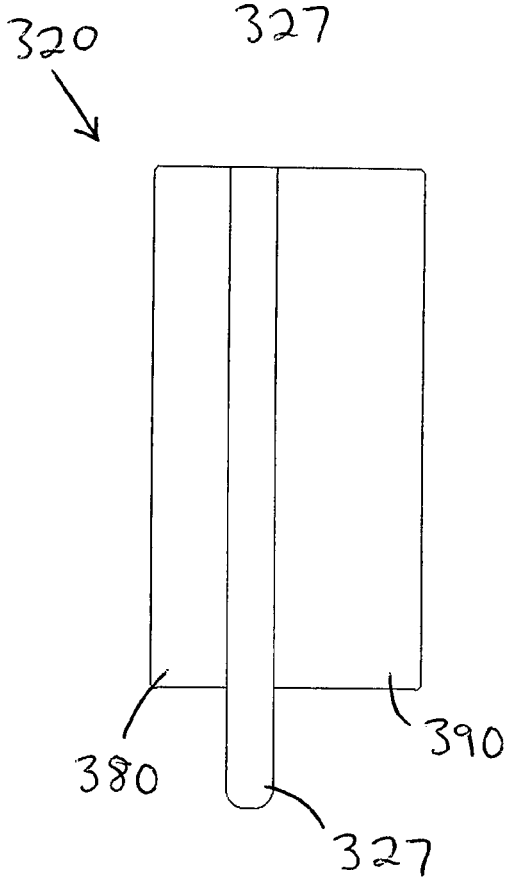
Fig. 22

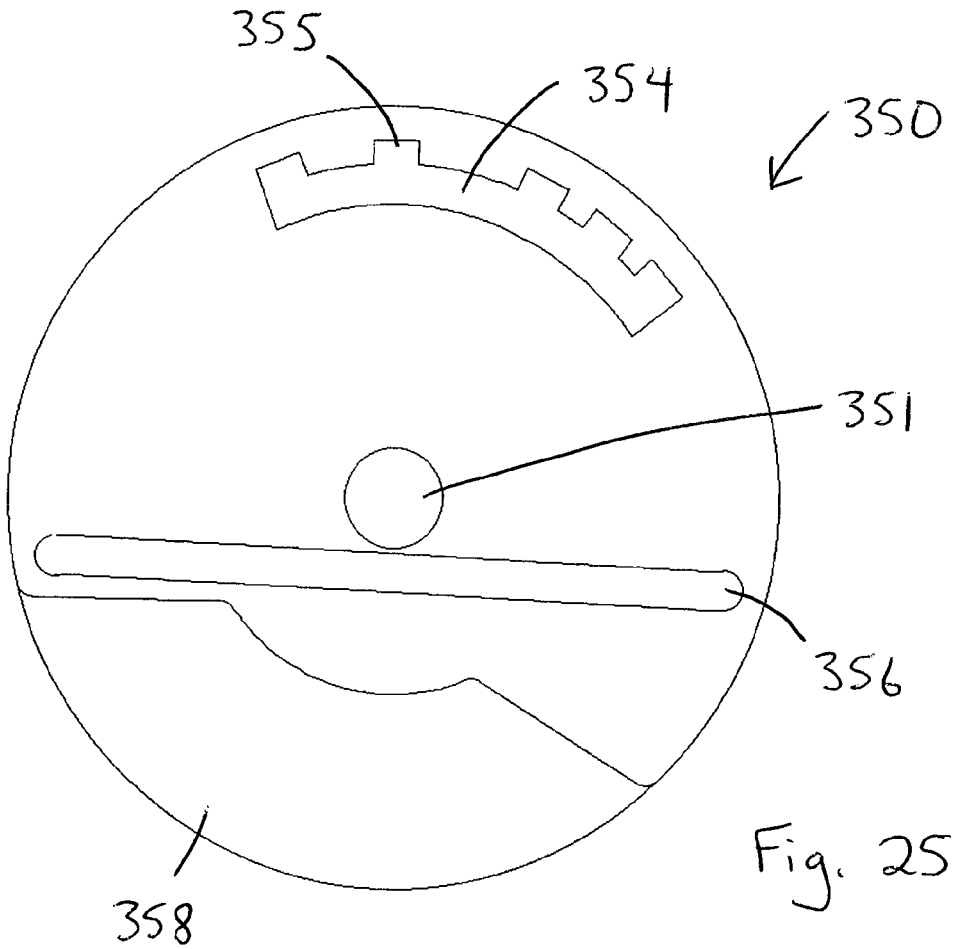
Fig. 25
Fig. 24
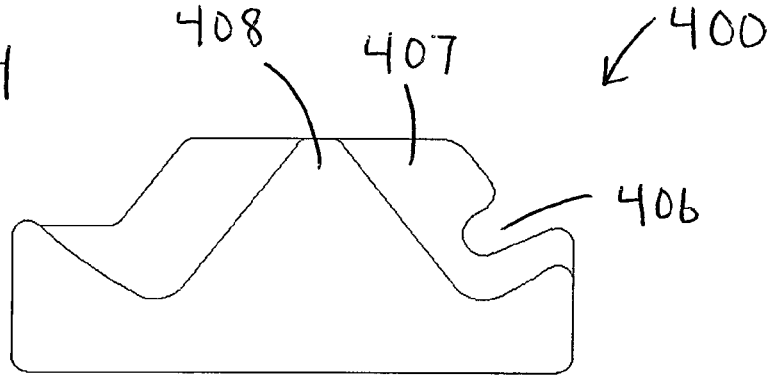

Fig. 26
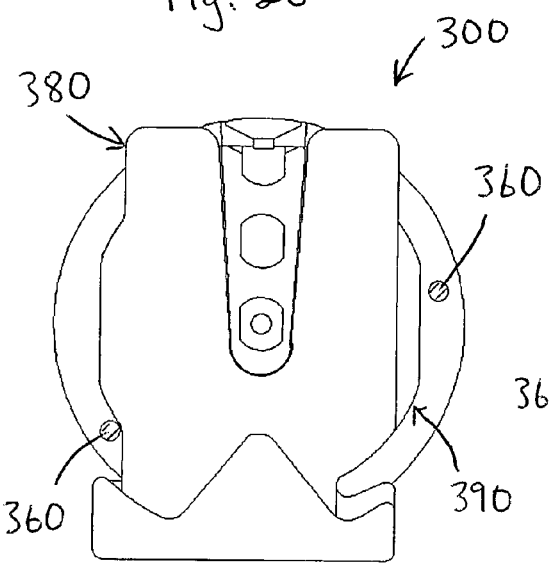
Fig. 27
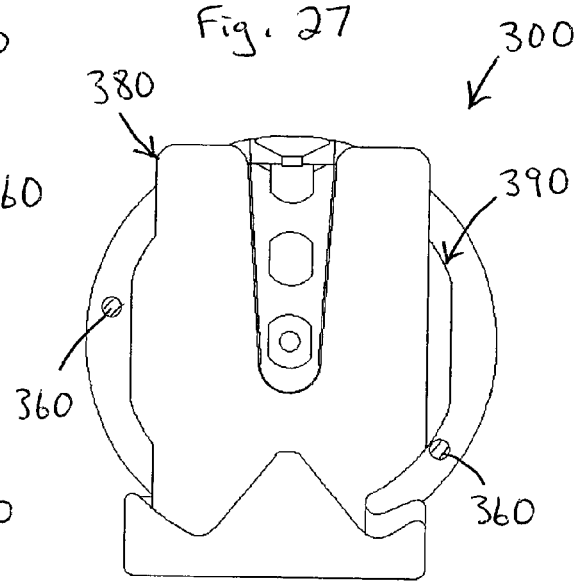
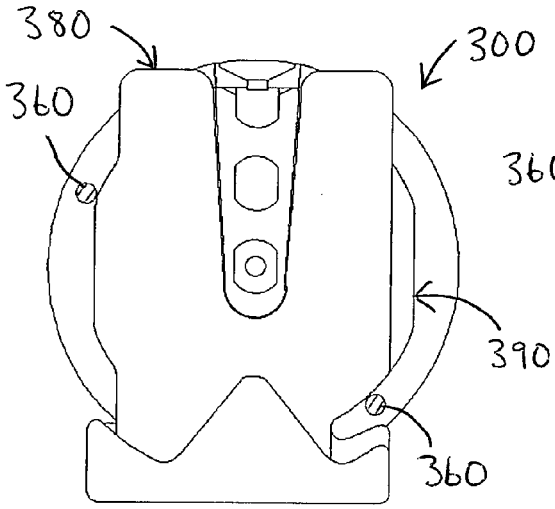
Fig. 28
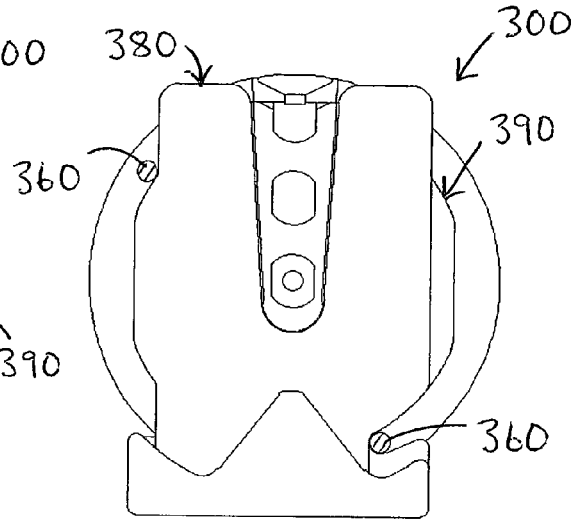
Fig. 29

Fig. 31
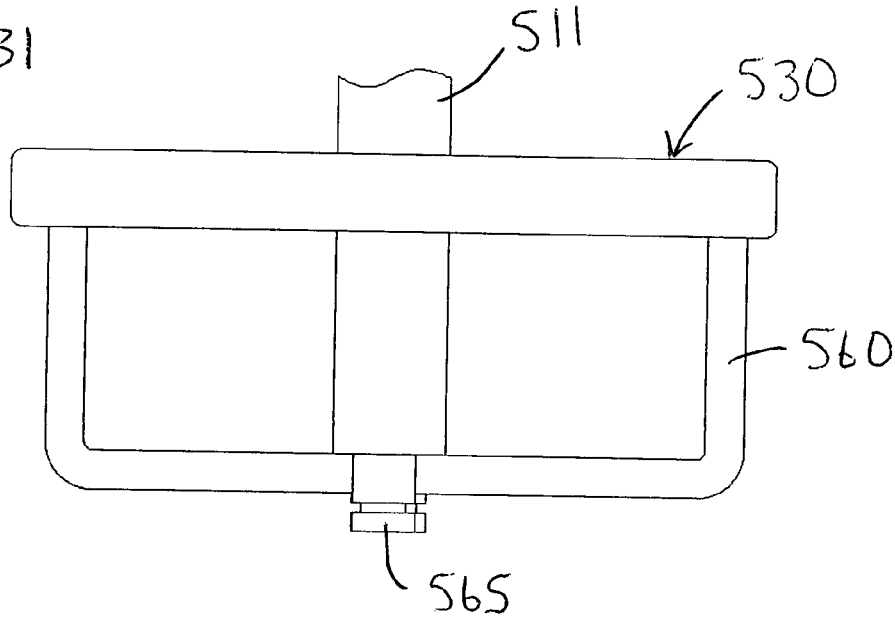
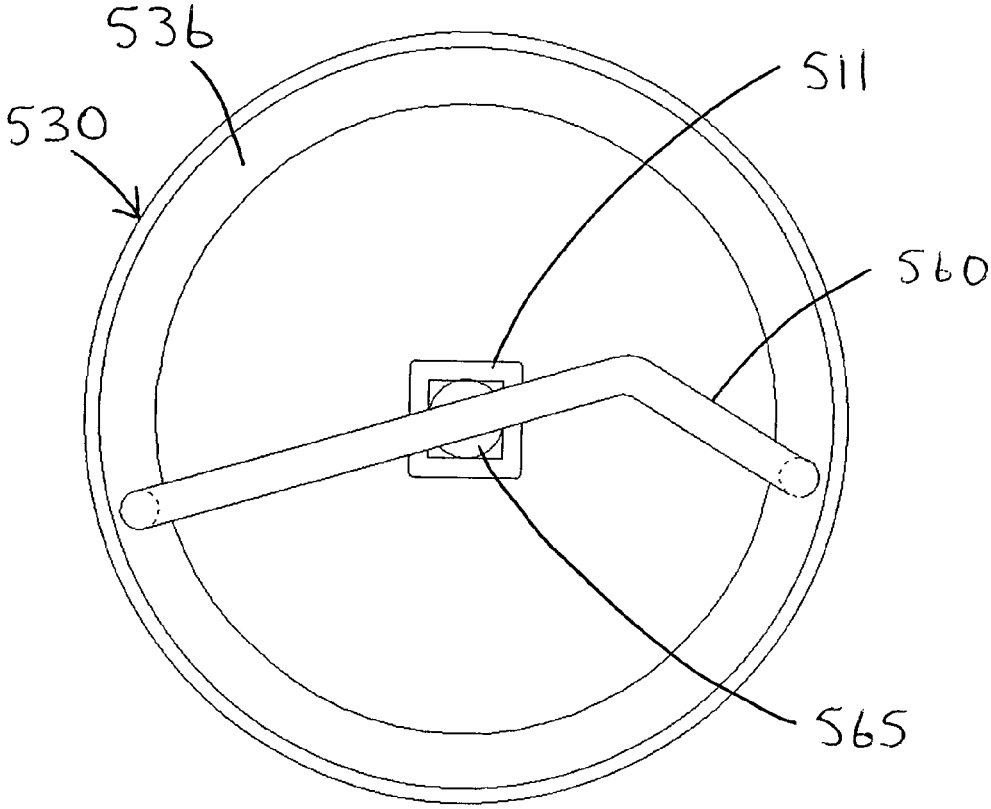
Fig. 30

EXERCISE WEIGHT ADJUSTMENT METHODS AND APPARATUS

FIELD OF THE INVENTION

The present invention relates to exercise equipment and in a preferred application, to methods and apparatus for adjusting weight on an exercise dumbbell.

BACKGROUND OF THE INVENTION

Past efforts have led to various inventions directed toward adjustable weight exercise devices. Some examples of such efforts in the field of free weights are disclosed in U.S. Pat. No. 3,771,785 to Speyer; U.S. Pat. No. 4,529,198 to Hettick, Jr.; U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; U.S. Pat. No. 5,839,997 to Roth et al.; U.S. Pat. No. 6,033,350 to Krull; U.S. Pat. No. 6,261,022 to Dalebout et al.; U.S. Pat. No. 6,322,481 to Krull; U.S. Pat. No. 6,540,650 to Krull; U.S. Pat. No. 6,746,381 to Krull; and U.S. Pat. No. 7,077,791 to Krull. Despite these advances and others in the field of weight lifting equipment, room for continued improvement remains with respect to selecting different combinations of weight for use on exercise dumbbells and the like.

SUMMARY OF THE INVENTION

The present invention provides methods and apparatus involving the movement of mass subject to gravitational force. In a preferred application, the present invention allows a person to adjust weight resistance by securing desired amounts of mass to a handlebar or other weight lifting member. A preferred embodiment of the present invention may be described in terms of exercise dumbbells. One such dumbbell comprises a handle member having a first weight supporting section, a second weight supporting section, and a handle that extends therebetween and defines a longitudinal axis. First weights are sized and configured to occupy the first weight supporting section, and second weights are sized and configured to occupy the second weight supporting section. At least one weight selector is rotatably mounted on the handle member for movement through an arcuate path about peripheral portions of the weights. Different locations along the path place the at least one weight selector beneath different combinations of the weights. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views, FIG. 1 is an end view of a first exercise dumbbell system constructed according to the principles of the present invention;

FIG. 2 is an end view of the dumbbell system of FIG. 1, with the lifting member removed to better illustrate the weight plates and the weight supporting base;

FIG. 12 is an end view of the dumbbell system of FIG. 1, with each weight plate of the type shown in FIG. 5 selectively connected to the lifting member of FIG. 4;

FIG. 13 is an end view of the dumbbell system of FIG. 1, with each weight plate of the type shown in FIG. 6 selectively connected to the lifting member of FIG. 4;

FIG. 14 is an end view of the dumbbell system of FIG. 1, with each weight plate of the types shown in FIGS. 5 and 6 selectively connected to the lifting member of FIG. 4;

FIG. 15 is an end view of the dumbbell system of FIG. 1, with each weight plate of the types shown in FIGS. 5 and 6, as well as the weight supporting base, selectively connected to the lifting member of FIG. 4;

FIG. 21 is an end view of a weight spacer that is a component of the dumbbell system of FIG. 16;

FIG. 22 is a side view of the weight spacer of FIG. 21;

FIG. 23 is a top view of the weight spacer of FIG. 21;

FIG. 24 is an end view of a weight supporting base that is a component of the dumbbell system of FIG. 16;

FIG. 25 is an interior end view of a knob that is a component of the dumbbell system of FIG. 16;

FIG. 26 is an end view of the dumbbell system of FIG. 16, with each weight plate of the type shown in FIG. 19 selectively connected to a lifting member that is a component of the dumbbell system of FIG. 16;

FIG. 27 is an end view of the dumbbell system of FIG. 16, with each weight plate of the type shown in FIG. 20 selectively connected to the lifting member referenced in the foregoing description of FIG. 26;

FIG. 28 is an end view of the dumbbell system of FIG. 16, with each weight plate of the types shown in FIGS. 19 and 20 selectively connected to the lifting member referenced in the foregoing description of FIG. 26;

FIG. 29 is an end view of the dumbbell system of FIG. 16, with each weight plate of the types shown in FIGS. 19 and 20, as well as the weight supporting base of FIG. 24, selectively connected to the lifting member referenced in the description of FIG. 26;

FIG. 30 is an end view of certain lifting member components of a third exercise dumbbell system constructed according to the principles of the present invention; and FIG. 31 is a top view of the components of FIG. 30.

DETAILED DESCRIPTION OF A PREFERRED EMBODIMENT

FIG. 1 shows an exercise dumbbell system 100 constructed according to the principles of the present invention. Generally speaking, the dumbbell system 100 includes a weight lifting member or handle member 110, a plurality of weight plates 180 and 190 that are selectively secured to the lifting member 110 to define a selectively adjustable dumbbell, and a base or cradle 200 that supports the weight plates 180 and 190 when not in use.

Figure 5:
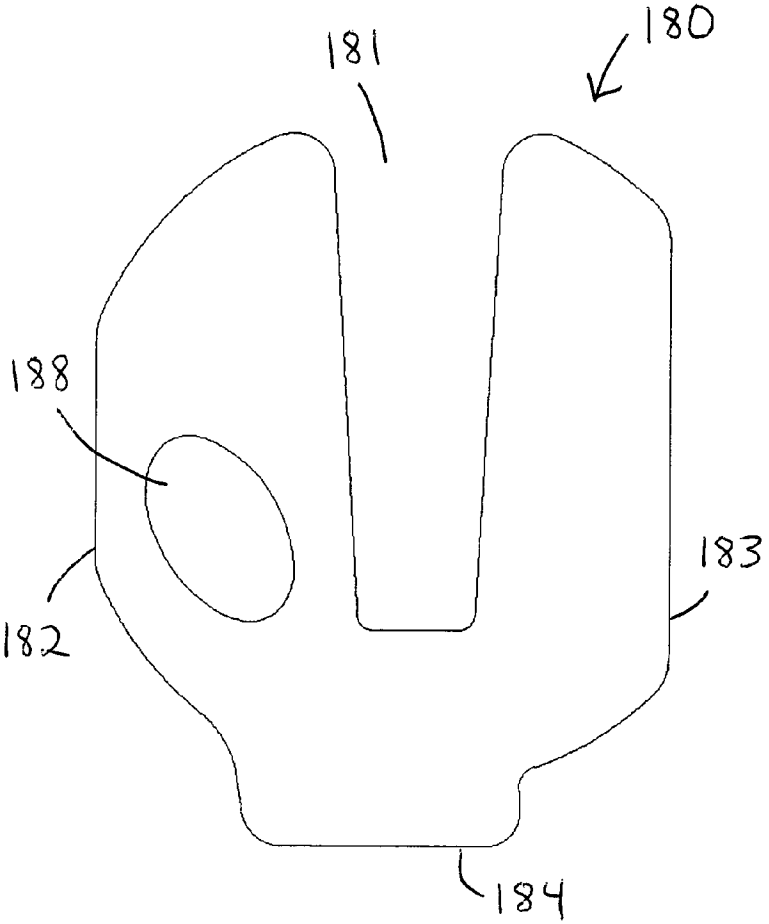
FIG. 5 is an end view of one of the weight plates of FIGS. 2 and 3.

One of the weight plates 180 is shown by itself in FIG. 5. Each weight plate 180 is preferably a stamped metal part that weighs one pound. However, other possible compositions, including cast metal, cement filled plastic shells, etc., may be used in the alternative as a matter of design choice. In any event, each weight plate 180 has a central, upwardly open slot 181 that extends through the thickness of the plate. The slot 181 is bounded by opposing, upwardly diverging sidewalls, which may also be described as inwardly facing sidewalls. The opposite sides of each weight plate 180 are bounded by contoured sidewalls 182 and 183 that may be described as outwardly facing sidewalls. Each weight plate 180 also has a lower end that is bounded by a flat, outwardly facing sidewall 184. The outwardly facing sidewalls cooperate with one another to define a periphery (which is interrupted at the top by the slot 181). A hole 188 may be provided in each weight plate 180 to position the center of mass relatively closer to the geometric center of the plate.

Figure 6:
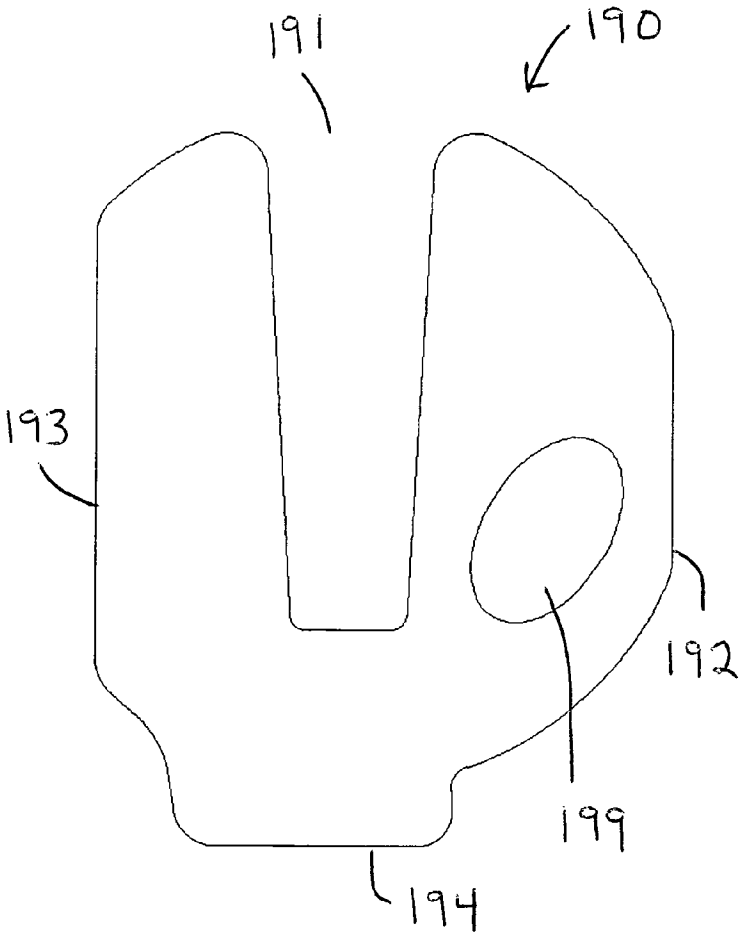
FIG. 6 is an end view of another of the weight plates of FIGS. 2 and 3.

One of the weight plates 190 is shown by itself in FIG. 6. Each weight plate 190 is preferably a stamped metal part that weighs two pounds. As noted above, other possible compositions, including cast metal, cement filled plastic shells, etc., may be used in the alternative as a matter of design choice. Moreover, it may be desirable to provide each weight plate 190 in the form of two identical one-pound plates. Such an approach might be considered particularly desirable with regard to the depicted plates 180 and 190 because the weight plates 190 have the same configuration as the weight plates 180 (except for thickness), and thus, only one tool would be required to make all of the plates 180 and 190. Depending on manufacturing constraints, it might be more desirable to proceed further along these lines and make the plates 180 as two separate stamped plates, and to make the plates 190 as four separate stamped plates, for example.

Like the weight plates 180, each weight plate 190 has a central, upwardly open slot 191 that extends through the thickness of the plate. The slot 191 is bounded by opposing, upwardly diverging sidewalls, which may also be described as inwardly facing sidewalls. The opposite sides of each weight plate 190 are bounded by contoured sidewalls 192 and 193 that may be described as outwardly facing sidewalls. Each weight plate 190 also has a lower end that is bounded by a flat, outwardly facing sidewall 194. The outwardly facing sidewalls cooperate with one another to define a periphery (which is interrupted at the top by the slot 191). A hole 199 may be provided in each weight plate 190 to position the center of mass relatively closer to the geometric center of the plate.

When in use, the weight plates 190 are "flipped" one hundred and eighty degrees relative to the weight plates 180 (so the sidewalls 182 and 193 face in a similar direction, and the sidewalls 183 and 192 face in a similar direction). As a result of this arrangement, the weight plates 180 extend further to the left when viewed as shown in FIG. 2, and the weight plates 190 extend further to the right when viewed as shown in FIG. 2.

Figure 3:
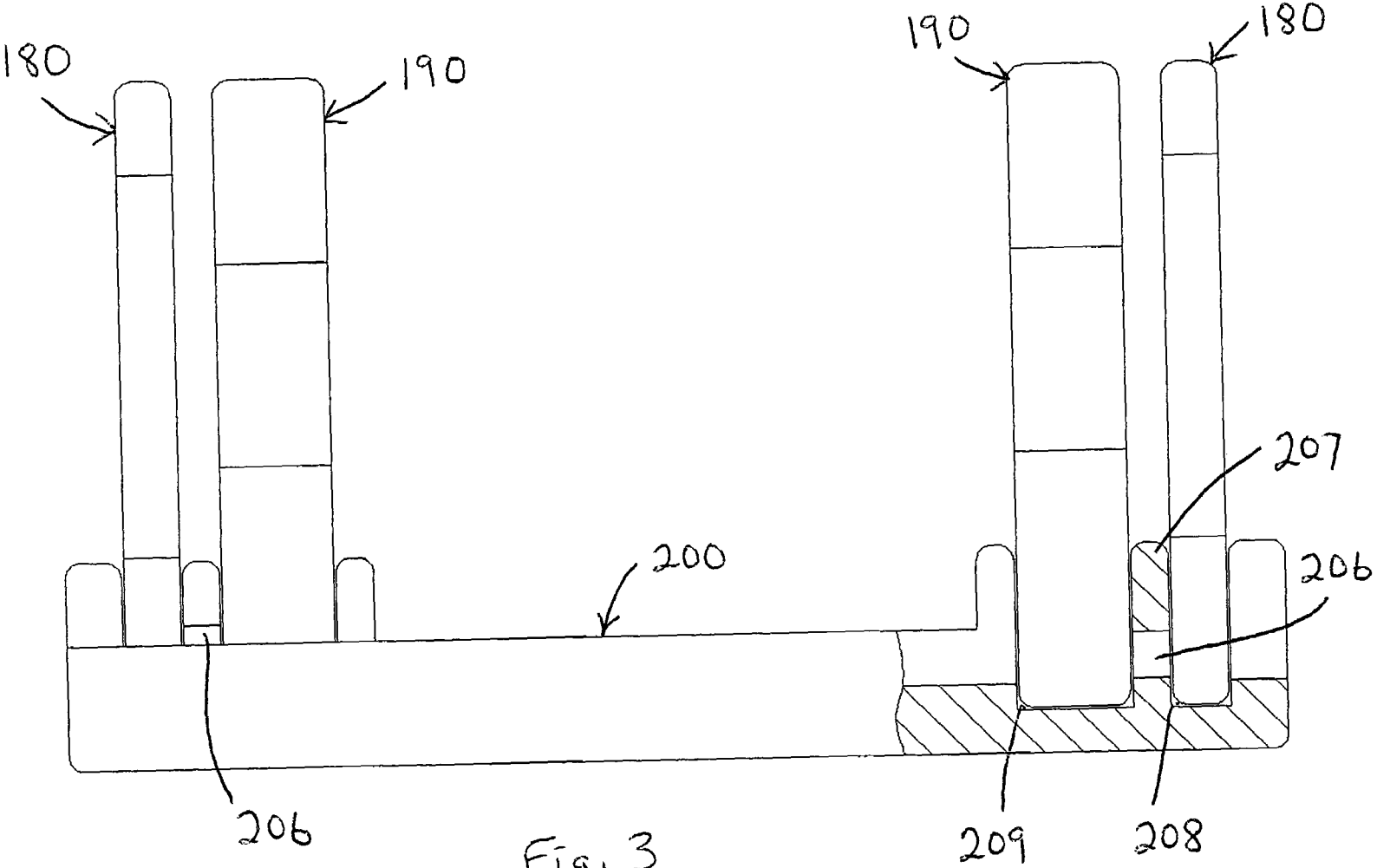
FIG. 3 is a partially sectioned side view of the weight plates and weight supporting base of FIG. 2.

FIGS. 2 and 3 show the weight plates 180 and 190 resting on the base 200. The base 200 is configured to rest on a flat surface, and to define upwardly opening compartments 208 and 209 that accommodate respective weight plates 180 and 190 in prescribed positions relative to one another. A rib or divider 207 extends between each set of adjacent compartments 208 and 209, and a notch 206 extends into the divider for reasons explained below. As shown in FIG. 2, the notch 206 aligns with the periphery of each weight plate 180 and 190. The base 200 is preferably an injection molded plastic part that is supplemented with ballast weight to arrive at a total weight of two pounds. On an alternative embodiment, the base 200 may be eliminated from the system by interconnecting at least one bar between the weight plates 180, and by interconnecting at least one bar between the weight plates 190. Additional information regarding the base 200 and other weight supporting arrangements, which alternatively may be described as means for supporting the weights 180 and 190 horizontal array apart from the lifting member 110, is disclosed in some of the patents referenced in the Background of the Invention, all of which are incorporated herein by reference.

Figure 4:
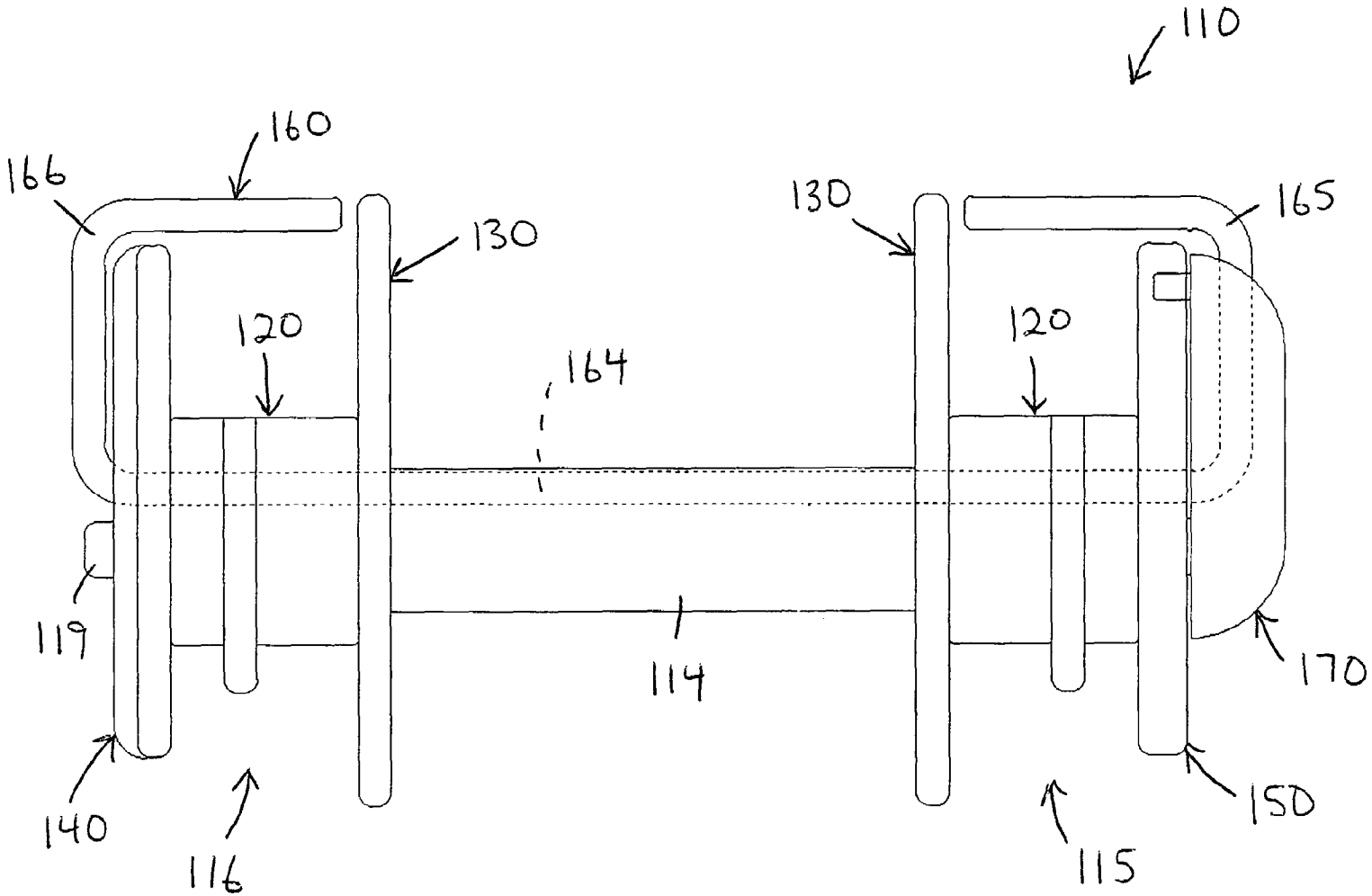
FIG. 4 is a side view of the lifting member removed from the dumbbell system of FIG. 1.
Figure 7:
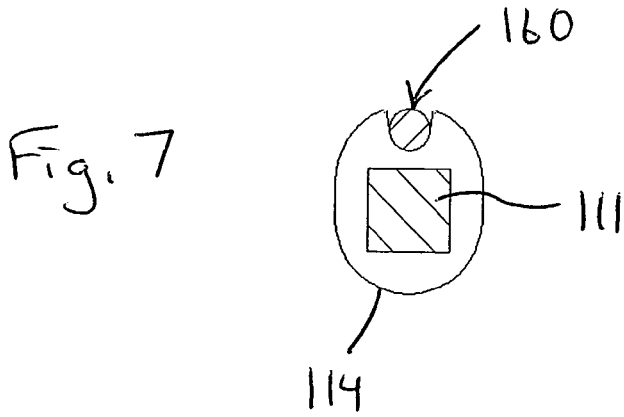
FIG. 7 is a partially sectioned end view of a handle on the lifting member of FIG. 4, with a support bar and a weight selector shown in relation thereto.

The lifting member 110 is shown by itself in FIG. 4. Generally speaking, the lifting member 110 includes an intermediate handle or hand grip 114, and first and second weight supporting sections 115 and 116 at opposite ends of the handle 114. As shown in FIG. 7, a solid steel bar 111 has a square cross-section and extends through the handle 114, as well as both weight supporting sections 115 and 116. Threaded holes 113 are formed in the ends of the bar 111 to receive respective end bolts 119, as further described below. FIG. 7 also shows the handle 114 together with a selector rod 160 that is described elsewhere in greater detail. The handle 114 is preferably molded rubber having an oval cross-section. An upwardly opening groove extends along the top of the handle 114 to accommodate or nest the selector rod 160. Also, a square hole extends longitudinally through the handle 114 to receive the square bar 111.

Figure 8:
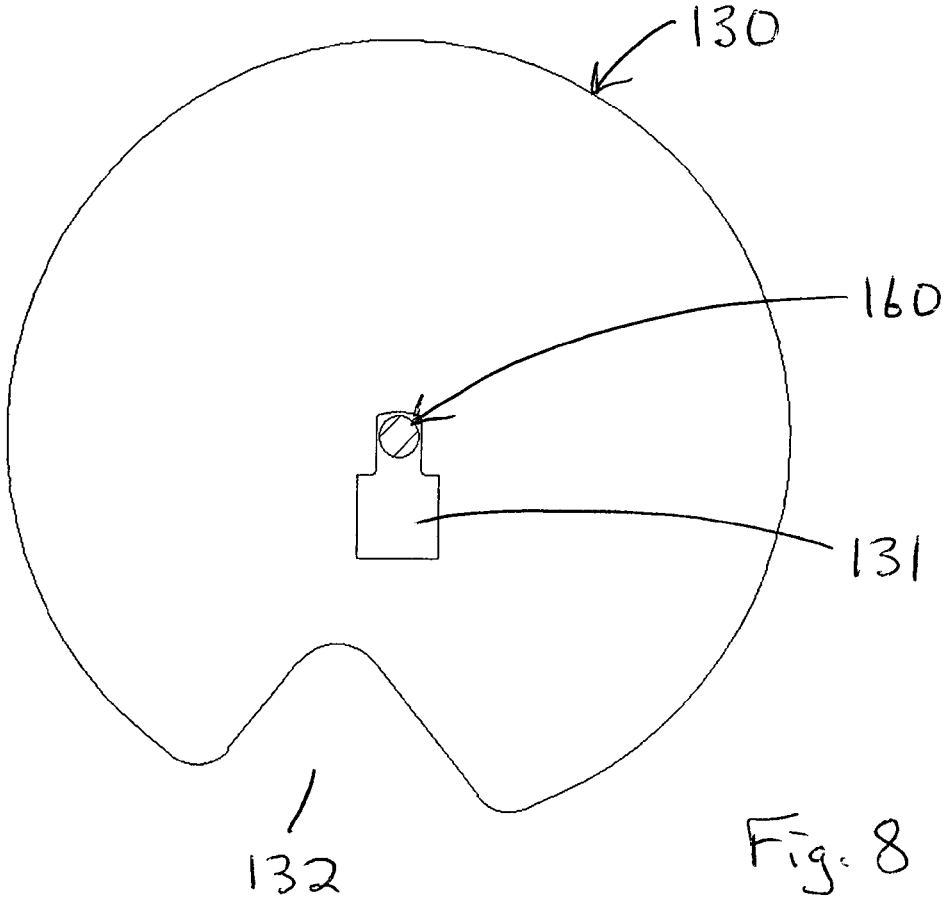
FIG. 8 is an end view of a panel on the lifting member of FIG. 4, with the weight selector of FIG. 7 shown in relation thereto.

Each weight supporting section 115 and 116 includes an inside panel or wall member 130. One such panel 130 is shown relative to the selector rod 160 in FIG. 8, and the other such panel 130 is a mirror image of the one depicted in FIG. 8. Each panel 130 may be described as a circular disc that is preferably injection molded plastic, and configured to bear against a respective end of the handle 114 (and a respective side of a user's hand). A square hole 131 extends perpendicularly through each panel 130 to receive the square bar 111. Also, an additional opening extends through each panel 130, adjacent the square hole 131, to receive the selector rod 160. A notch 132 extends into a lower portion of the sidewall of the panel 130 to accommodate a similarly shaped tab or wall on the base 200.

Figure 11:
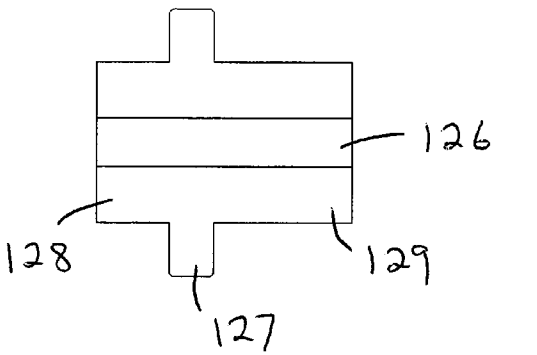
FIG. 11 is a top view of the weight spacer of FIGS. 9 and 10.
Figure 10:
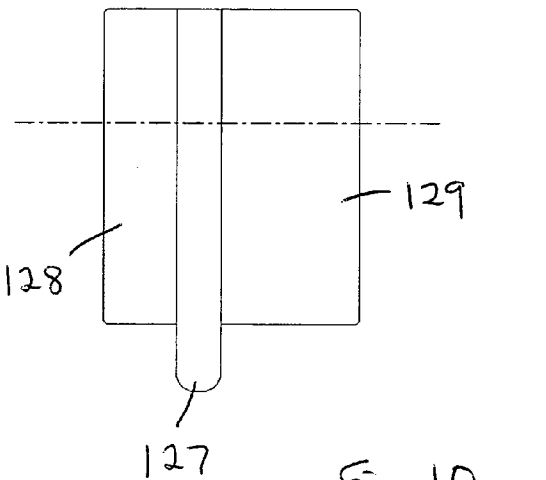
FIG. 10 is a side view of the weight spacer of FIG. 9.
Figure 9:
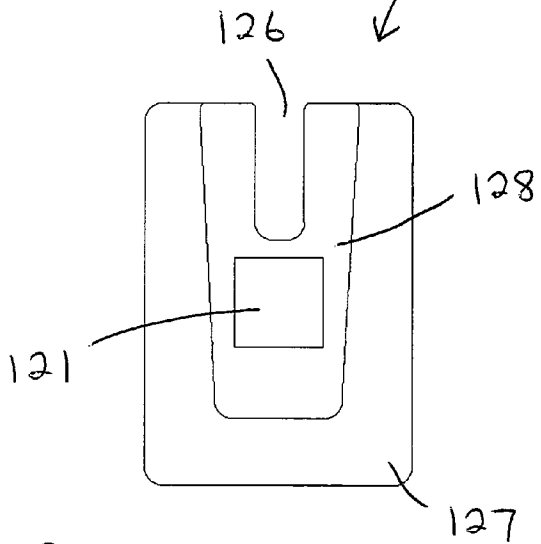
FIG. 9 is an end view of a weight spacer on the lifting member of FIG. 4.

Each weight supporting section 115 and 116 also includes a spacer member 120 that is shown by itself in FIGS. 9-11. Each spacer member 120 is preferably an injection molded plastic part. Each spacer member 120 includes an intermediate divider or plate portion 127, a first relatively narrower hub portion 128 that extends in a first direction away from the divider 127, and a second relatively narrower hub portion 129 that extends in an opposite, second direction away from the divider 127. The first hub portion 128 is configured to span a respective weight plate 180, and to insert downward into its respective slot 181. The second hub portion 129 is configured to span a respective weight plate 190, and to insert downward into its respective slot 191. A square hole 121 extends longitudinally through each spacer member 120 to accommodate the square bar 111. An upwardly opening groove 126 extends longitudinally through each spacer member 120 to accommodate the selector rod 160.

Each weight supporting section 115 and 116 further includes a respective outside panel or wall member 140 or 150. Each panel 140 and 150 may be described as a circular disc that is preferably injection molded plastic. As on the inside panels 130, a square hole extends perpendicularly through each outside panel 140 and 150 to receive the square bar 111, and an additional, adjacent opening extends through each panel 140 and 150 to receive the selector rod 160. The outside panels 140 and 150 also have notches similar in configuration to the notches 132 in respective inside panels 130, to accommodate respective tabs at opposite ends of the base 200. As compared to the inside panels 130, the panels 140 and 150 have a relatively smaller diameter. Each outside panel 140 and 150 is configured to receive a nested metal washer, through which a respective bolt 119 is inserted and then threaded into a respective end of the square bar 111. The opposite end bolts 119 and washers cooperate to clamp or hold the handle 114 and weight supporting sections 115 and 116 therebetween. The spacer members 120 cooperate with the outside panels 140 and 150 and the inside panels 130 to accommodate respective weight plates 180 and 190 in the same prescribed positions as the base 200.

For reasons discussed below, holes 156 extend into the outwardly facing end of the panel 150, and these holes 156 are located along an arc that is centered about the longitudinal axis of the selector rod 160. Also, weight indicia 157 appear on the outwardly facing end of the panel 150 in diametric opposition to respective pairs of the holes 156.

The selector rod 160 is preferably a bent steel rod that has a circular cross-section, and that may be described in terms of three integrally connected segments. As shown in FIG. 4, an intermediate segment 164 of the selector rod 160 extends lengthwise through the handle 114 and both weight supporting sections 115 and 116, thereby rotatably connecting the selector rod 160 to the lifting member 110. One end of the intermediate segment 164 integrally joins an end segment 165 that is generally L-shaped. The end segment 165 extends radially away from the intermediate segment 164, and then back across the weight supporting section 115 at a radial distance from the intermediate segment 164. Similarly, an opposite end of the intermediate segment 164 integrally joins an end segment 166, which is a mirror image of the end segment 165. In other words, the end segment 166 is also generally L-shaped and extends radially away from the intermediate segment 164, and then back across the weight supporting section 116 at the same radial distance from the intermediate segment 164. In the alternative, the selector rod 160 may be described in terms of an intermediate portion and two U-shaped portions, if the intermediate portion is defined as the segment that spans the handle 114.

The radial distance between the distal end portions of the selector rod 160 and the rotational axis is greater than both the outside radius of the outside panels 140 and 150, and an outside radius defined by the peripheral portions of the weight plates 180 and 190, thereby allowing the distal end portions to move along an arcuate path about these other components. On the other hand, the radial distance is less than the outside radius of the inside panels 130, thereby establishing the inside panels 130 as barriers between a user's hand and the distal ends of the selector rod 160.

A user manipulated knob or handle 170 is secured to the end segment 165 of the selector rod 160 and is thereby constrained to rotate together therewith. For example, the knob 170 may be formed of multiple pieces of injection molded plastic that are fastened together with the end segment 165 captured therebetween. At least a portion of the knob 170 (or a component thereof) is resilient and functions as a leaf spring with two pegs 176 (see FIG. 1) projecting from a distal end thereof. The pegs 176 are configured and arranged to enter any two adjacent holes 156 in the outside panel 150. In the alternative, one or more helical springs may be housed within the knob to bias relatively more pegs outward into the holes, in which case, it would not be necessary to deflect the knob axially in order to free it for rotation. In any event, the knob 170 is selectively rotated (together with the selector rod 160) relative to the outside panel 150 to place the pegs 176 in alignment with desired holes 156. A window 175 in an opposite end of the knob 160 aligns with the indicia 157 on the outside panel 150 to indicate how much force will be required to lift the lifting member 110 and any weight plates 180 or 190 secured thereto (as a result of the selector rod 160 rotating into position beneath them). The resilient nature of the knob 170 biases the pegs 176 toward the outside panel 150, so the knob 170 must first be pulled away from the outside panel 150 to enable rotation.

FIG. 1 shows the selector rod 160 to one side of all of the weight plates 180 and 190, and a "2" appears in the window 175 to correctly indicate that two pounds of force is required to lift the lifting member 110 away from the base 200 and the weight plates 180 and 190. In other words, the lifting member 110 is free to be lifted upward without any of the weight plates 180 and 190, and the lifting member 110 is constructed to weigh two pounds.

FIG. 12 shows the selector rod 160 rotated to a position beneath or underlying the weight plates 180, and a "4" appears in the window 175 to correctly indicate that four pounds of force is required to lift the lifting member 110 and the weight plates 180 away from the base 200 and the weight plates 190. In other words, both one-pound weight plates 180 are constrained to be lifted upward together with the two-pound lifting member 110.

FIG. 13 shows the selector rod 160 rotated to a position beneath or underlying the weight plates 190, and a "6" appears in the window 175 to correctly indicate that six pounds of force is required to lift the lifting member 110 and the weight plates 190 away from the base 200 and the weight plates 180. In other words, both two-pound weight plates 190 are constrained to be lifted upward together with the two-pound lifting member 110.

FIG. 14 shows the selector rod 160 rotated to a position beneath or underlying all of the weight plates 180 and 190, and a "8" appears in the window 175 to correctly indicate that 8 pounds of force is required to lift the lifting member 110 and all of the weight plates 180 and 190 away from the base 200. In other words, both one-pound weight plates 180 and both two-pound weight plates 190 are constrained to be lifted upward together with the two-pound lifting member 110.

FIG. 15 shows the selector rod 160 rotated to a position beneath or underlying all of the weight plates 180 and 190, as well as the base wall 207, and a "10" appears in the window 175 to correctly indicate that ten pounds of force is required to lift the lifting member 110, all of the weight plates 180 and 190, and the base 200. In other words, both one-pound weight plates 180, both two-pound weight plates 190, and the two-pound base 200 are constrained to be lifted upward together with the two-pound lifting member 110.

Among other things, the embodiment 100 may be deemed advantageous because only a single knob 170 is turned in order to adjust weight at both ends of the dumbbell. Moreover, the base 200 may be selectively connected to the lifting member 110 to facilitate transport of the entire system with one handle 114 in each hand.

Figure 16:
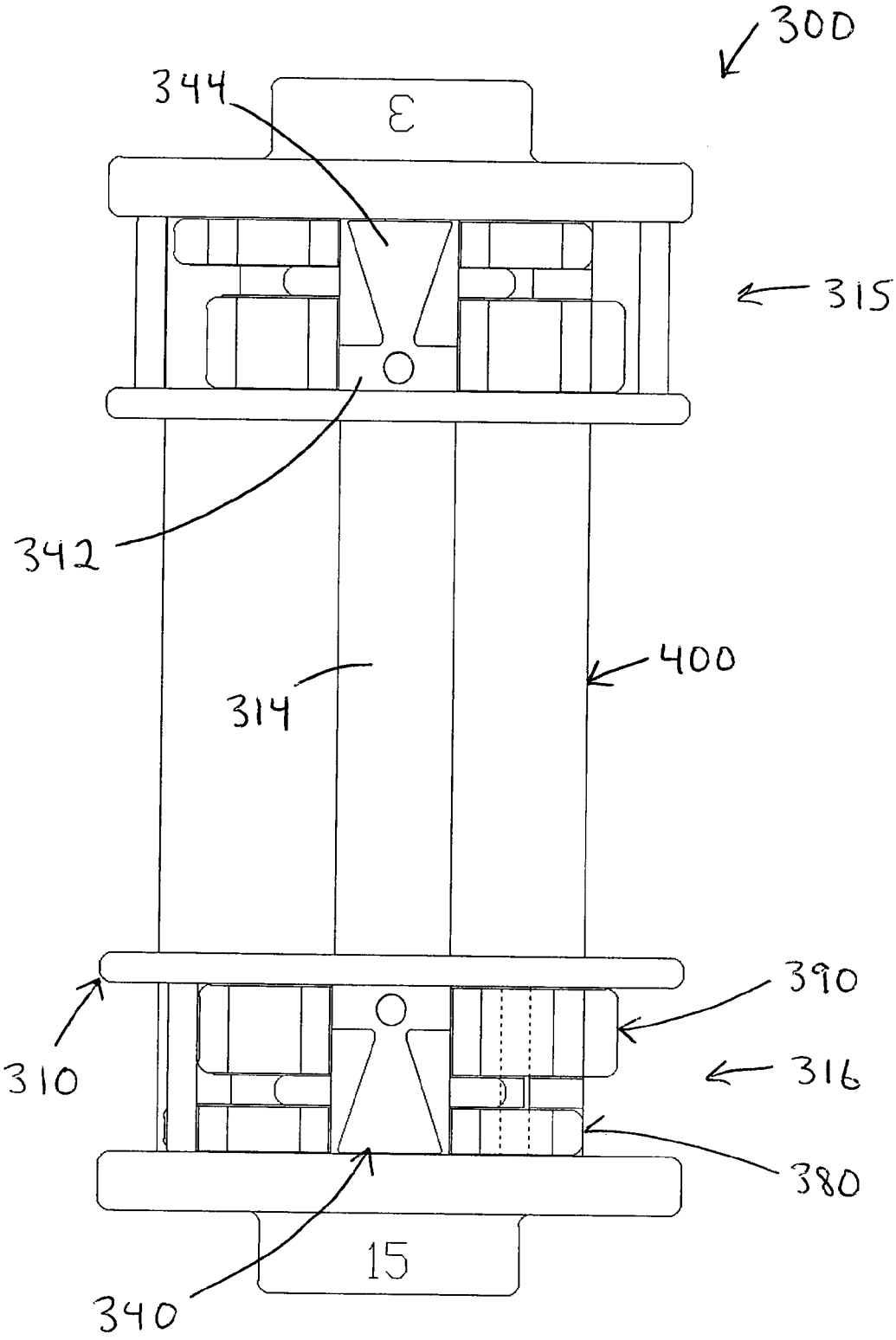
FIG. 16 is a top view of a second exercise dumbbell system constructed according to the principles of the present invention.

FIG. 16 shows another exercise dumbbell system 300 constructed according to the principles of the present invention. Generally speaking, the dumbbell system 300 includes a weight lifting member or handle member 310, a plurality of weight plates 380 and 390 that are selectively secured to the lifting member 310 to define a selectively adjustable dumbbell, and a base or cradle 400 that supports the weight plates 380 and 390 when not in use.

Figure 19:
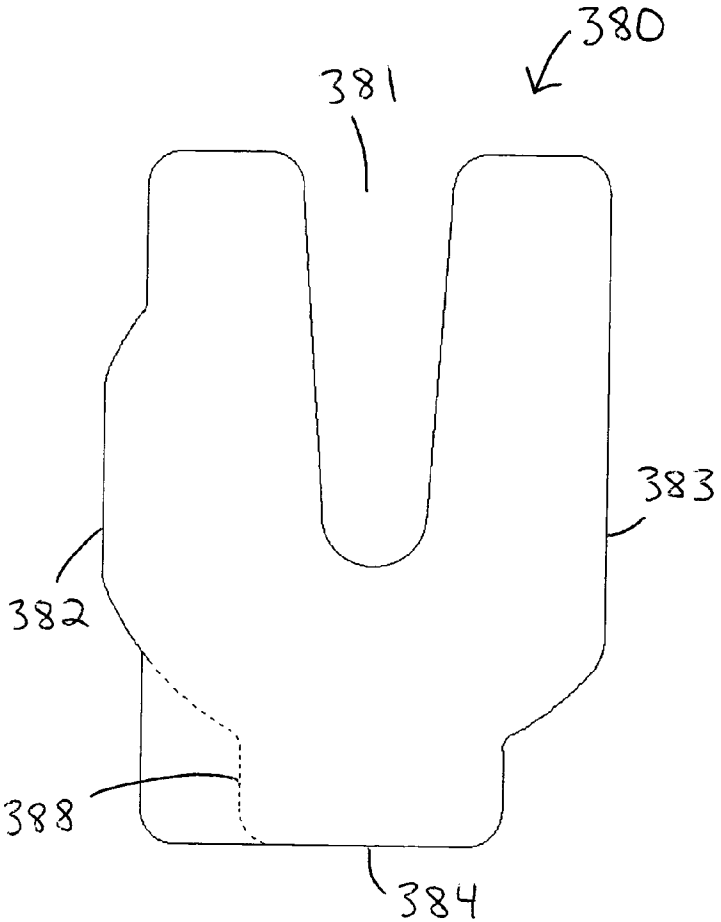
FIG. 19 is an end view of one of the weight plates that is a component of the dumbbell system of FIG. 16.

One of the weight plates 380 is shown by itself in FIG. 19. Each weight plate 380 is preferably a stamped metal part that weighs one and one-half pounds. However, other possible compositions, including cast metal, cement filled plastic shells, etc., may be used in the alternative as a matter of design choice. In any event, each weight plate 380 has a central, upwardly open slot 381 that extends through the thickness of the plate. The slot 381 is bounded by opposing, upwardly diverging sidewalls, which may also be described as inwardly facing sidewalls. The opposite sides of each weight plate 380 are bounded by contoured sidewalls 382 and 383 that may be described as outwardly facing sidewalls. Each weight plate 380 also has a lower end that is bounded by a flat, outwardly facing sidewall 384. The outwardly facing sidewalls cooperate with one another to define a periphery (which is interrupted at the top by the slot 381). A dashed line 388 shows an alternative peripheral sidewall configuration that would make the periphery of the weight plate 380 identical to the periphery of the weight plate 390 (described in the next paragraph), recognizing that the plates 380 would have to be made slightly thicker to compensate for the loss of mass.

Figure 20:
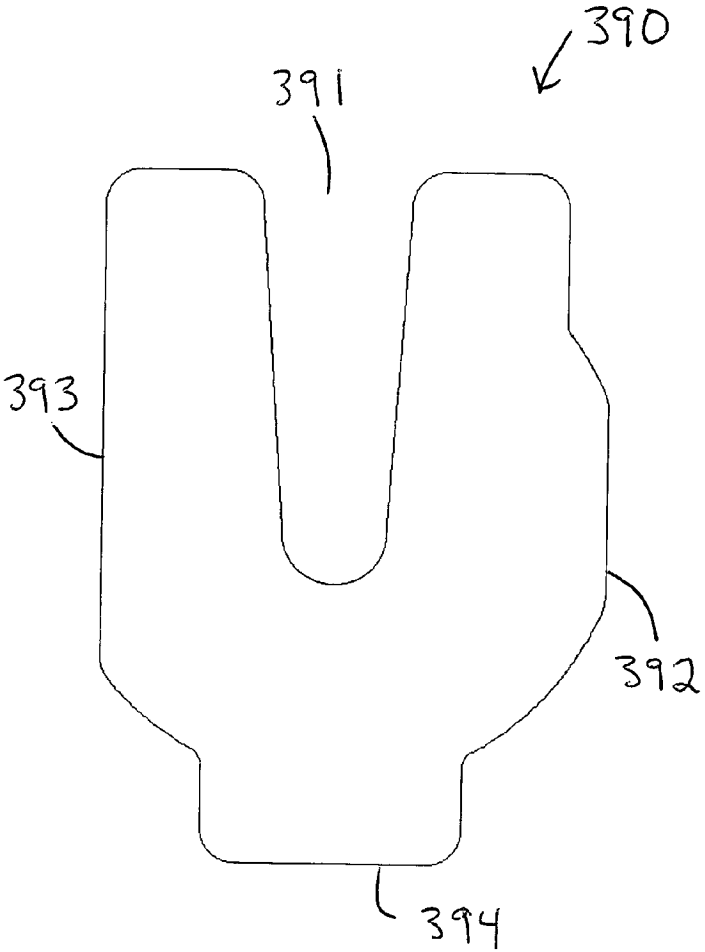
FIG. 20 is an end view of another of the weight plates that is a component of the dumbbell system of FIG. 16.

One of the weight plates 390 is shown by itself in FIG. 20. Each weight plate 390 is preferably a stamped metal part that weighs two pounds. As noted above, other possible compositions, including cast metal, cement filled plastic shells, etc., may be used in the alternative as a matter of design choice. Moreover, it may be desirable to provide each weight plate 190 in the form of two identical one and one-half pound plates, in the event that the alternative periphery is provided on the weight plates 380, since only one tool would be required to make all of the plates 380 and 390. Depending on manufacturing constraints, it might be more desirable to proceed further along these lines and make the plates 380 as two separate stamped plates, and to make the plates 390 as four separate stamped plates, for example.

Like the weight plates 380, each weight plate 390 has a central, upwardly open slot 391 that extends through the thickness of the plate. The slot 391 is bounded by opposing, upwardly diverging sidewalls, which may also be described as inwardly facing sidewalls. The opposite sides of each weight plate 390 are bounded by contoured sidewalls 392 and 393 that may be described as outwardly facing sidewalls. Each weight plate 390 also has a lower end that is bounded by a flat, outwardly facing sidewall 394. The outwardly facing sidewalls cooperate with one another to define a periphery (which is interrupted at the top by the slot 391).

When in use, the weight plates 390 are "flipped" one hundred and eighty degrees relative to the weight plates 380 (so the sidewalls 382 and 393 face in a similar direction, and the sidewalls 383 and 392 face in a similar direction). As a result of this arrangement, the weight plates 380 extend further to the left when viewed as shown in FIG. 18, and the weight plates 390 extend further to the right when viewed as shown in FIG. 18.

Figure 18:
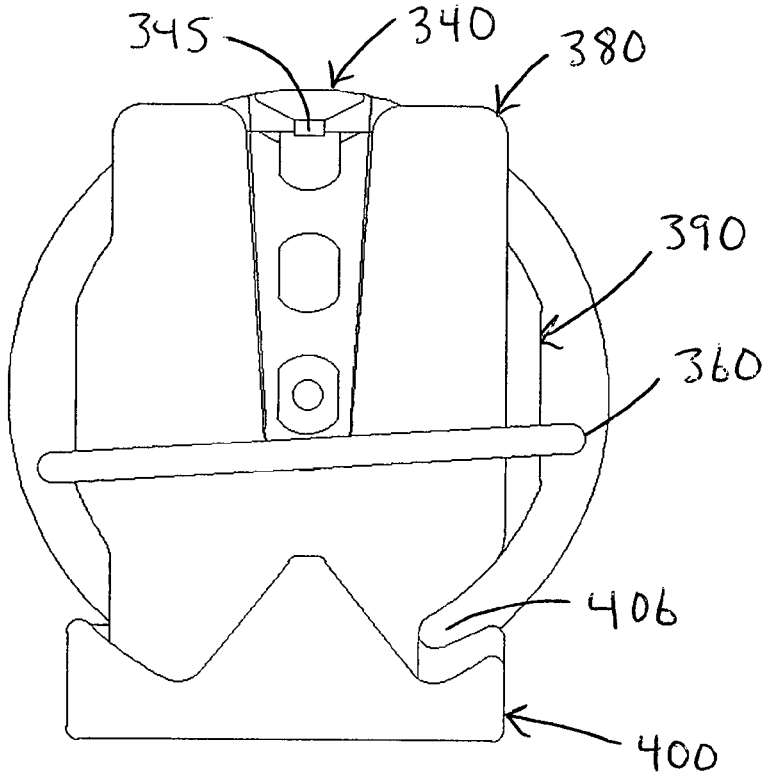
FIG. 18 is an end view of the dumbbell system of FIG. 16 with certain components removed to better illustrate other components.

FIG. 18 shows the weight plates 380 and 390 resting on the base 400 with parts of the lifting member 110 removed. The base 400 is functionally similar to the base 200. In this regard, the base 400 is similarly configured to rest on a flat surface, and to define upwardly opening compartments that accommodate and/or maintain respective weight plates 380 and 390 in prescribed positions relative to one another. As shown in FIG. 24, a rib or divider 407 extends upward between each set of adjacent compartments, and a notch 406 extends into the divider 407 for reasons explained below. As shown in FIG. 18, the notch 406 aligns with the periphery of each weight plate 380 and 390. The base 400 is preferably an injection molded plastic part that is supplemented with ballast weight to arrive at a total weight of three pounds (as opposed to two pounds for the base 200). On an alternative embodiment, the base 400 may be eliminated from the system by interconnecting at least one bar between the weight plates 380, and by interconnecting at least one bar between the weight plates 390. Additional information regarding various weight supporting arrangements is disclosed in some of the patents already incorporated herein by reference.

Generally speaking, the lifting member 310 includes an intermediate handle or hand grip 314, and first and second weight supporting sections 315 and 316 at opposite ends of the handle 314. A solid steel bar extends through the handle 314 and both weight supporting sections 315 and 316. The cross-section of the bar may be described as a circle with diametrically opposed flat surfaces cut into it. An advantage of this configuration is that some parts may be keyed to the bar, while others may be rotatably mounted on the bar, as further described below. The handle 314 is preferably molded rubber having an oval cross-section. A hole, similar in cross-section to that of the bar, extends longitudinally through the handle 314 to receive the bar in a manner that keys the handle 314 to the bar.

Each weight supporting section 315 and 316 includes an inside panel or wall member 330. Each panel 330 may be described as a circular disc that is preferably injection molded plastic, and configured to bear against a respective end of the handle 314 (and a respective side of a user's hand). A circular hole extends perpendicularly through each panel 330 to receive the bar in a manner that rotatably mounts the panel on the bar. Also, a notch extends into a lower portion of the sidewall of each panel 330 to accommodate rotation of the panel through a limited range of orientations relative to a tab or wall on the base 400 (the tab is a mirror image of the tab 408 shown in FIG. 24). A mirror image of this notch is shown in FIG. 25 with reference to an outside panel described below.

Each weight supporting section 315 and 316 also includes a spacer member 320 that is shown by itself in FIGS. 21-23. Each spacer member 320 is preferably an injection molded plastic part. Each spacer member 320 includes an intermediate divider or plate portion 327, a first relatively narrower hub portion 328 that extends in a first direction away from the divider 327, and a second relatively narrower hub portion 329 that extends in an opposite, second direction away from the divider 327. The first hub portion 328 is configured to span a respective weight plate 380, and to insert downward into its respective slot 381. The second hub portion 329 is configured to span a respective weight plate 390, and to insert downward into its respective slot 391. A hole 321, similar in cross-section to that of the aforementioned bar, extends longitudinally through each spacer member 320 to receive the bar in a manner that keys the spacer relative to the bar. As shown in FIG. 21, one or more additional openings 322 may be provided through the spacers 320 to conserve material and/or to receive ballast weight.

As shown in FIGS. 21 and 23, the top of each spacer 320 is configured to accommodate a respective leaf spring or latching member 340. In this regard, the top of each spacer member 320 may be described in terms of two discrete sections. The inward section, which occupies a position relatively closer to the handle 314, provides a flat, upwardly facing surface with a hole 323 extending downward through the surface. As shown in FIG. 16, a base portion 342 of the latching member 340 is secured to the inward section by means of a screw or other suitable fastener. In addition or in the alternative, the inward section may be configured to slidably receive the base portion 342 of the latching member 340 in a direction parallel to the longitudinal axis of the handle 314. The outward section, which occupies a position relatively farther from the handle 314, defines an upwardly opening channel 325 that is configured to accommodate downward deflection of an opposite, distal portion or push-button end 344 of the latching member 340.

Each weight supporting section 315 and 316 further includes a respective outside panel or knob 350. Each knob 350 may be described as a "two-tiered" cylindrical disc that is preferably injection molded plastic. The outside diameter of the relatively larger diameter "tier" or disc 352 is equal to that of the inside panels 330. The relatively smaller diameter "tier" or disc 353 is preferably sized and configured for rotation by a person's hand.

Figure 17:
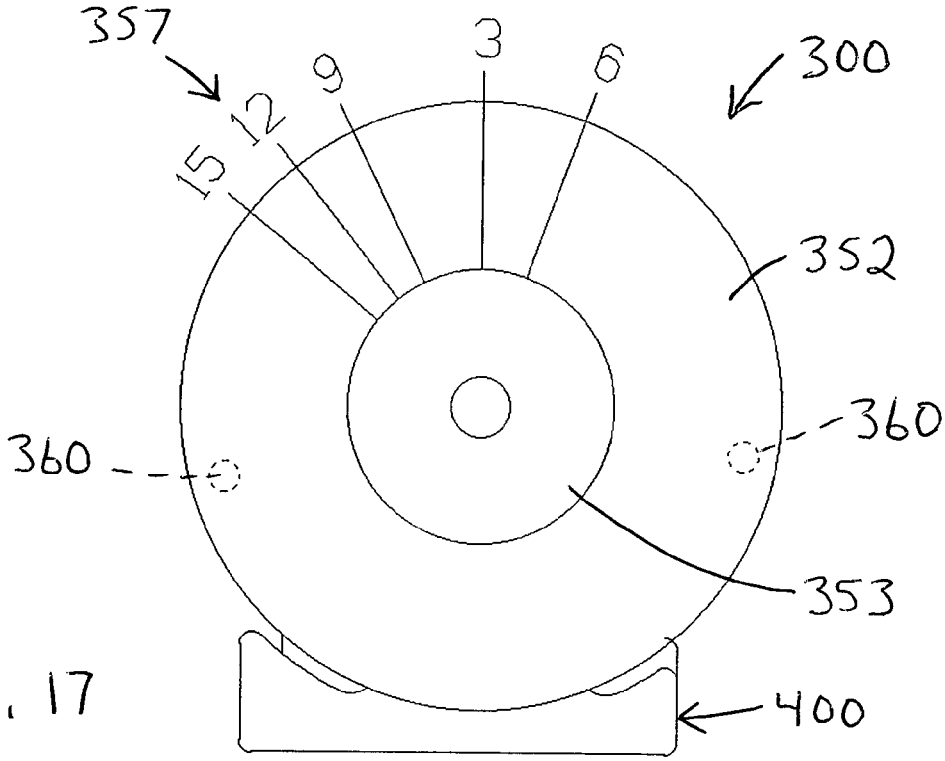
FIG. 17 is an end view of the dumbbell system of FIG. 16.

FIG. 25 shows one of the knobs 350 by itself (and from a perspective opposite of that provided in FIG. 17). As on the inside panels 330, a circular hole 351 extends perpendicularly through each knob 350 to receive the aforementioned bar in a manner that rotatably mounts the knob on the bar. Also, the relatively larger diameter disc 352 has a recessed area or notch 358 to accommodate the tab 408 on a respective end of the base 400 and to accommodate rotation of the knob 350 through a limited range of orientations relative thereto. An elongate recessed area or groove 356 is provided in the disc 352 to accommodate an intermediate portion of a selector rod 360 as further explained below. An arcuate recessed area or channel 354 is provided in the disc 352 to accommodate rotation of the knob 350 relative to a tab 345 on the push-button end 344 of the latching member 340. Also, rectangular recessed areas or notches 355 intersect the channel 354 at circumferentially spaced locations along the channel 354 to receive the tab 345 and thereby latch the knob 350 against rotation relative thereto.

Each knob 350 is configured to receive a nested metal washer, through which a respective bolt is inserted and then threaded into a respective end of the aforementioned bar. The opposite end bolts and washers cooperate to hold the handle 314 and weight supporting sections 315 and 316 therebetween. The spacer members 320 cooperate with the knobs 350 and the inside panels 330 to accommodate respective weight plates 380 and 390 in the same prescribed positions as the base 300. If desired, stationary panels or bushings may be disposed between the rotating panels 350 and 330 and the stationary spacer members 320, and keyed to the aforementioned bar in the same fashion as the spacer members 320.

For reasons discussed below, holes 156 extend into the outwardly facing end of the panel 150, and these holes 156 are located along an arc that is centered about the longitudinal axis of the selector rod 160. FIG. 17 shows weight indicia 357 that appear in the indicated locations on the outwardly facing cylindrical wall of the smaller cylinder 353. Each location aligns with a respective notch 355 in an opposite side of the knob 350.

On this embodiment 300, the selector rod is separated into a first selector rod 360 associated with the first weight supporting section 315, and a second selector rod 360 associated with the second weight supporting section 316. Each selector rod 360 is preferably a bent steel rod that has a circular cross-section, and that may be described in terms of three integral segments that cooperate to define a generally U-shaped configuration. An intermediate segment of each selector rod 360 extends perpendicular to the axis of rotation defined by the knobs 350, and nests inside the groove 356 in a respective knob 350. First and second distal end portions or legs of each selector rod 360 extend perpendicularly away from respective ends of the intermediate portion at a radial distance from the axis. This radial distance is slightly greater than an outside radius defined by the peripheral portions of the weight plates 380 and 390, thereby allowing the distal end portions of the selector rods 360 to travel along respective arcuate paths about these other components. The distal ends of each selector rod 360 are secured in respective holes in a respective inside panel 330, thereby linking rotation of each knob 350 to rotation of a respective inside panel 330.

FIGS. 17 and 18 show the selector rods 360 beyond both sides of all of the weight plates 380 and 390, and a "3" appears on top of each knob 350 to correctly indicate that three pounds of force is required to lift the lifting member 310 away from the base 400 and the weight plates 380 and 390. In other words, the lifting member 310 is free to be lifted upward without any of the weight plates 380 and 390, and the lifting member 310 is constructed to weigh three pounds.

FIG. 26 shows the selector rods 360 rotated to respective positions beneath or underlying the weight plates 380, and a "6" appears on top of each knob 350 to correctly indicate that six pounds of force is required to lift the lifting member 310 and the weight plates 380 away from the base 400 and the weight plates 390. In other words, both one-and-one-half-pound weight plates 380 are constrained to be lifted upward together with the three-pound lifting member 310.

FIG. 27 shows the selector rods 360 rotated to respective positions beneath or underlying the weight plates 390, and a "9" appears on top of each knob 350 to correctly indicate that nine pounds of force is required to lift the lifting member 310 and the weight plates 390 away from the base 400 and the weight plates 380. In other words, both three-pound weight plates 390 are constrained to be lifted upward together with the three-pound lifting member 310.

FIG. 28 shows the selector rods 360 rotated to respective positions beneath or underlying all of the weight plates 380 and 390, and a "12" appears on top of each knob 350 to correctly indicate that twelve pounds of force is required to lift the lifting member 310 and all of the weight plates 380 and 390 away from the base 400. In other words, both one-and-one-half-pound weight plates 380 and both three-pound weight plates 390 are constrained to be lifted upward together with the three-pound lifting member 310.

FIG. 29 shows the selector rods 360 rotated to respective positions beneath or underlying all of the weight plates 380 and 390, as well as the base wall 307, and a "15" appears on top of each knob 350 to correctly indicate that fifteen pounds of force is required to lift the lifting member 310, all of the weight plates 380 and 390, and the base 400. In other words, both one-and-one-half-pound weight plates 380, both three-pound weight plates 390, and the three-pound base 400 are constrained to be lifted upward together with the three-pound lifting member 310.

Among other things, the embodiment 300 may be deemed advantageous in certain respects. For example, additional weight amounts may be obtained by setting one knob 350 to a first amount, and setting the other knob 350 to the next higher or next lower amount. Such an approach allows a person the option of lifting four and one-half pounds, seven and one-half pounds, or ten and one-half pounds. Also, the provision of opposing selector rod segments accommodates all adjustment combinations without movement of any selector rod segment across the top of any weight plate.

FIGS. 30-31 show portions of another embodiment of the present invention, with the understanding that the majority of the non-depicted parts are comparable to those described above with reference to the previous embodiment 300. This alternative embodiment has a square tubular bar 511 that extends through the handle and both weight supporting sections. As a result, square holes extend through the handle and weight supporting sections to key these part to the bar 511. Also, a square hole extends through the inside panel 530 to key the inside panel 530 to the bar 511. A ring member 536 is rotatably mounted on the outwardly facing side of the inside panel 530, and is provided with holes to receive the distal ends of the modified weight selector 560.

A solid cylindrical bar 565 is rotatably nested inside the bar 511 and extends beyond each end of the bar 511. The ends of the bar 565 are forked or slotted to receive the intermediate portions of respective selectors 560. The outside panels or knobs are provided with a different, V-shaped groove to receive the intermediate portions of respective selectors 560, which are bent to align with the rotational axis of the bar 565. A circumferential groove is provided near each end of the bar 565 to receive a C-clip and thereby secure a respective knob to a respective end of the bar 565 (for rotation together with the weight selectors 560). Other fastening methods may be used in the alternative.

Among other things, the arrangement shown in FIGS. 30-31 may be deemed advantageous because only one knob need be turned in order to adjust weight at both ends of the dumbbell. Also, since the weight selectors 560 at each end of the dumbbell are constrained to rotate together, only one outside panel or knob need be provided in the form of a user manipulable adjustment member, if so desired. This arrangement also operates without moving any selector rod segment across the top of any weight plate. Another, similar alternative embodiment may be constructed by substituting a pair of bolts for each weight selector 560, and securing the bolts between respective rings 536 and respective outside panels.

The subject invention has been described with reference to a few specific embodiments with knowledge that various improvements, modifications, and/or substitutions may be made thereto. For example, various known arrangements and/or combinations may be used to bias the knobs toward desired orientations and/or to lock the knobs in desired orientations. Moreover, features of the various embodiments may be mixed and matched to arrive at additional embodiments. Persons skilled in the art will also recognize that the present invention may be implemented with different sizes and/or quantities of weight plates, and that any associated weight supporting base may or may not be configured for connection to the lifting member.

The present invention may also be described in and/or interpreted with reference to alternative terms and/or arrangements that are functionally equivalent to those specifically mentioned above. For example, the periphery of each weight plate may alternatively be described as a profile when viewed from an end of the dumbbell. Moreover, the periphery of each weight plate may have additional features that make it look different and/or be subject to a different description but nonetheless have the same functional attributes of the weight plates disclosed herein. For example, additional lobes may extend outward from the weight plate to locations above or below the ends of the arcuate path traversed by the selector rod segments without interfering with the portion of the weight plate that is critical to operation of the dumbbell.

The present invention may also be described in terms of various methods relative to the apparatus disclosed herein. For example, the present invention may be described in terms of a method of adjusting weight resistance to exercise, including the steps of providing a lifting member with at least one weight selector that moves through an arcuate path centered about a rotational axis; a first weight configured and arranged to occupy a first space relative to the lifting member; and a second weight configured and arranged to occupy a discrete, second space relative to the lifting member, wherein part of each said weight is disposed directly between the arcuate path and the rotational axis; and selectively moving the at least one weight selector along the arcuate path from a first position, free from beneath each said weight, to a second position, underlying a peripheral portion of only the first weight, to a third position, underlying a respective peripheral portion of each said weight.

Recognizing that this disclosure will enable persons skilled in the art to derive additional modifications, improvements, and/or applications that nonetheless embody the essence of the invention, the scope of the present invention is to be limited only to the extent of the following claims.

What is claimed is:

1. An exercise dumbbell, comprising:

a lifting member having a handle, a first weight supporting section disposed at a first end of the handle, and a second weight supporting section disposed at an opposite, second end of the handle;

first weights sized and configured to be supported by the first weight supporting section;

second weights sized and configured to be supported by the second weight supporting section;

a first weight selector rotatably mounted on the lifting member for selective movement along an arcuate path that partially circumnavigates the first weights, from a first position, free from beneath all of the first weights, to a second position, beneath a peripheral sidewall of only one of the first weights, to a third position, beneath respective peripheral sidewalls of at least two said first weights; and a second weight selector rotatably mounted on the lifting member for selective movement along an arcuate path that partially circumnavigates the second weights, from a first position, free from beneath all of the second weights, to a second position, beneath a peripheral sidewall of only one of the said second weights, to a third position, beneath respective peripheral sidewalls of at least two said second weights.

2. The exercise dumbbell of claim 1, wherein the first weight selector and the second weight selector are integral portions of a unitary selector member having an intermediate portion that extends through the handle.

3. The exercise dumbbell of claim 1, wherein the first weight selector is movable to a fourth position, beneath only a discrete one of the first weights.

4. The exercise dumbbell of claim 1, further comprising biasing means for biasing each said weight selector to remain in any given said position.

5. The exercise dumbbell of claim 1, wherein the first weight selector includes a first segment that spans respective first peripheral sidewalls of all said first weights, and a second segment that spans opposite, respective second peripheral sidewalls of all of said first weights.

6. The exercise dumbbell of claim 1, wherein the first weights are bounded by upper edges that lie beneath the arcuate path of the first weight selector.

7. An exercise dumbbell, comprising:

a set of first weights, wherein each of the first weights has a discrete profile when viewed from an end of the dumbbell;

a set of second weights, wherein each of the second weights has a discrete profile when viewed from an end of the dumbbell;

a lifting member having a handle, a first weight supporting section disposed at a first end of the handle and configured to receive the first weights, a second weight supporting section disposed at an opposite, second end of the handle and configured to receive the second weights;

at least one weight selector rotatably mounted on the lifting member for rotation about a rotational axis, wherein the at least one weight selector includes (a) first segment that moves through an arcuate path about a portion of each said profile associated with the first weights, (b) a second segment that moves through an arcuate path about a portion of each said profile associated with the second weights, and only a portion of each said arcuate path underlies respective said weights, and (c) a third segment, wherein the third segment and the first segment span respective, opposites sides of the first weights.

8. The exercise dumbbell of claim 1, wherein the at least one weight selector includes a third segment that moves through an arcuate path about a discrete portion of each said profile associated with the first weights, and the weight selector is movable to a position wherein the first rod segment and the third rod segment are disposed beyond respective opposite sides of the first weights.

9. An adjustable weight exercise device, comprising:

a lifting member including at least one weight supporting section;

at least one selector rod rotatably mounted on the lifting member for rotation about a rotational axis, wherein the at least one selector rod includes at least one rod segment that extends parallel to the rotational axis at a radial distance from the rotational axis; and at least two weights configured to occupy respective positions within the at least one weight supporting section, including space disposed directly between the rotational axis and the at least one rod segment, wherein each of the weights has a discrete peripheral portion that accommodates arcuate travel of the at least one selector rod from a first position, free from beneath all of the weights, to a second position, underlying only one of the weights, to a third position, underlying at least two of the weights.

10. The exercise device of claim 9, further comprising biasing means for biasing the at least one selector rod to remain in any given said position.

11. The exercise dumbbell of claim 1, wherein the first weight selector moves about an axis, spans respective peripheral sidewalls of all said first weights, and is movable to a position radially outward beyond said peripheral sidewalls.

12. The exercise dumbbell of claim 1, further comprising a means for supporting the weights in a horizontal array apart from the lifting member.

13. The exercise dumbbell of claim 12, wherein the first weight selector moves about an axis, and includes first and second segments that are separated by a distance measured perpendicular to the axis, and each of the first weights has a maximum width measured perpendicular to the axis and perpendicular to vertical, and each said maximum width is less than said distance at a respective location along said axis.

14. The exercise dumbbell of claim 1, wherein the first weight selector includes a first segment that engages said one of the first weights when the first weight selector occupies the second position, and the first weight selector includes a second segment that engages said one of the first weights when the first weight selector occupies a fourth position along the arcuate path associated with the first weight selector.

15. The exercise dumbbell of claim 1, wherein the first weight selector and the second weight selector are movable independent of one another.

16. The exercise dumbbell of claim 7, wherein the first segment and the second segment are movable independent of one another.

17. The exercise dumbbell of claim 8, wherein the first segment engages one of the first weights when the at least one weight selector occupies a first orientation, and the third segment engages said one of the first weights when the at least one weight selector occupies a second orientation.

18. The exercise device of claim 9, wherein the at least one rod segment includes a first rod segment that engages said one of the weights when the at least one selector rod occupies the second position, and the at least one rod segment includes a second rod segment that engages said one of the weight when the at least one selector rod is rotated to a fourth position.

* * * * *